US008117792B2

(12) United States Patent
Kim et al.

(10) Patent No.: US 8,117,792 B2
(45) Date of Patent: Feb. 21, 2012

(54) FIXING STRUCTURE OF INSULATION PANEL OF PREFABRICATED REFRIGERATOR AND PREFABRICATED REFRIGERATOR HAVING THE SAME

(75) Inventors: Young-Bae Kim, Busan (KR); Kyung-Do Kim, Busan (KR); Dong-Ju Jung, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 1109 days.

(21) Appl. No.: 11/619,215

(22) Filed: Jan. 3, 2007

(65) Prior Publication Data

US 2007/0152551 A1 Jul. 5, 2007

(30) Foreign Application Priority Data

Jan. 3, 2006 (KR) ..... 10-2006-0000676

(51) Int. Cl.
*F27D 1/00* (2006.01)
*A47B 96/04* (2006.01)

(52) U.S. Cl. ..... 52/506.02; 52/588.1; 52/309.14

(58) Field of Classification Search ..... 52/79.1, 52/106, 506.02, 588.1, 582.1, 589.1, 592.1, 52/309.9, 309.14; 62/440; 312/401, 400, 312/406, 406.2, 409
See application file for complete search history.

(56) References Cited

U.S. PATENT DOCUMENTS 2,053,873 A * 9/1936 Niederhofer ..... 52/213
2,240,916 A * 5/1941 Springford et al. ..... 312/401
2,647,287 A * 8/1953 Jones ..... 52/582.2
3,353,314 A * 11/1967 Melcher ..... 52/127.9
3,564,801 A * 2/1971 Huerta ..... 2/580
3,587,199 A * 6/1971 Henry ..... 2/582.2
3,729,889 A * 5/1973 Baruzzini ..... 52/264
3,780,481 A * 12/1973 Tomkins ..... 52/265
4,844,975 A * 7/1989 Litzenberger ..... 428/306.6
5,348,778 A * 9/1994 Knipp et al. ..... 428/35.8
5,497,589 A * 3/1996 Porter ..... 52/309.7
5,613,338 A * 3/1997 Esposito ..... 52/588.1
5,720,142 A * 2/1998 Morrison ..... 52/309.9
5,921,095 A 7/1999 Lee et al.
6,119,427 A * 9/2000 Wyman et al. ..... 52/584.1
6,314,701 B1 * 11/2001 Meyerson ..... 52/588.1
6,418,686 B1 * 7/2002 Record ..... 52/309.15
6,874,331 B2 * 4/2005 Chandler et al. ..... 62/256
6,997,530 B2 * 2/2006 Avendano et al. ..... 312/401
7,021,010 B2 * 4/2006 Smith et al. ..... 52/169.12
7,216,464 B2 * 5/2007 Neal et al. ..... 52/584.1
7,377,082 B1 * 5/2008 Edwards ..... 52/588.1
2001/0013211 A1 * 8/2001 Rudden ..... 52/539
2002/0011035 A1 * 1/2002 Boyer et al. ..... 52/79.5
2002/0189182 A1 * 12/2002 Record ..... 52/309.9
2004/0174106 A1 * 9/2004 Uekado et al. ..... 312/401
2006/0076863 A1 * 4/2006 Echigoya et al. ..... 312/401

* cited by examiner

*Primary Examiner* — Khoi Tran
*Assistant Examiner* — Jason Holloway
(74) *Attorney, Agent, or Firm* — Fish & Richardson P.C.

(57) ABSTRACT

Disclosed are a fixing structure of insulation panels and a prefabricated refrigerator with the same. The fixing structure of insulation panels includes a recess recessed on one surface of a first insulation panel having an insulation portion inside a casing, and a protrusion formed to be inserted into the recess, on one surface of a second insulation panel having an insulation portion inside a casing, wherein the insulation portions of nonmetal material are exposed to a bottom of the recess and a front end of the protrusion so as to shield a transmission path of heat flowed along a casing contact surface of the insulation panels, thereby improving insulation efficiency.

20 Claims, 5 Drawing Sheets

FIXING STRUCTURE OF INSULATION PANEL OF PREFABRICATED REFRIGERATOR AND PREFABRICATED REFRIGERATOR HAVING THE SAME

RELATED APPLICATION

The present disclosure relates to subject mater contained in priority Korean Application No. 10-2006-0000676, filed on Jan. 3, 2006, which is herein expressly incorporated by reference in its entirety.

BACKGROUND OF THE INVENTION

1. Field of the Invention

The present invention relates to a prefabricated refrigerator, and more particularly, to a prefabricated refrigerator having high insulation efficiency by improving a fixing structure of insulation panels constituting a cabinet of the prefabricated refrigerator.

2. Description of the Background Art

Generally, a prefabricated refrigerator 1 is assembled in such a manner that sandwich panels 10, 20 and 30 having polyurethane foam therein are fixed to one another as shown in FIGS. 1 and 2. In other words, the prefabricated refrigerator 1 includes a bottom panel 10 constituting the base of a cooling space, a sidewall panel 20 constituting the surrounding of the bottom panel 10 to match a groove 10*a* of the bottom panel 10, a cover panel 30 covering a top portion of the sidewall panel 20, and a cooling mechanism 40 fixed to a top surface of the cover panel 30 to cool the cooling space of the prefabricated refrigerator 1. In this case, each of the panels 10, 20 and 30 is provided with a groove 10*a* and a protrusion 20*a* to facilitate assembly with adjacent panels 10, 20 and 30.

A structure of the sidewall panel 20 will be described with reference to FIG. 3. The sidewall panel 20 includes casings 21*a* and 22*a* formed of a metal material to prevent the sidewall panel from being damaged by external impact, and insulation portions 21*b* and 22*b* foamed inside the casings 21*a* and 22*a* by polyurethane foam. The sidewall panel 20 is assembled in such a manner that a protrusion 22*c* of each of the panels 21 and 22 is fitted to a groove 21*c*.

However, if each of the panels 21 and 22 is completely assembled, a contact boundary surface is formed so that surfaces of the casings 21*a* and 22*a* formed of a metal material having high heat conductivity coefficient are in contact with each other. Since this boundary surface serves as a path 90 that transfers heat from the outside of the cabinet of the refrigerator to the inside corresponding to the cooling space, a problem occurs in that insulation efficiency is greatly deteriorated even though the panels 21 and 22 is provided with the insulation portions 21*b* and 22*b*.

Accordingly, problems occur in that power consumption of the prefabricated refrigerator increases due to increase of heat conductivity through the contact surface of the casings, and the condition habitable for mold or bacilli is provided due to the dew formed in a gap by the externally transferred heat. Meanwhile, to remove mold or bacilli, a sterilizing material may be filled with the gap between the casings. In this case, another problem occurs in that quality of appearance is deteriorated.

SUMMARY OF THE INVENTION

Therefore, an object of the present invention is to provide a prefabricated refrigerator having high insulation efficiency, in which a fixing structure of insulation panels of a cabinet of the prefabricated refrigerator is improved to effectively shield heat transferred from the outside of the cabinet to the inside of the cabinet along a contact surface of the insulation panels.

Another object of the present invention is to provide a prefabricated refrigerator in which fixing strength of insulation panels is improved.

Another object of the present invention is to provide a prefabricated refrigerator having high insulation efficiency, in which a fixing structure of insulation panels is improved to minimize the amount of heat transferred in a thickness direction of the insulation panels.

To achieve these and other advantages and in accordance with the purpose of the present invention, as embodied and broadly described herein, there is provided a fixing structure of insulation panels of a prefabricated refrigerator, constituting a cabinet of the prefabricated refrigerator, which comprises a recess recessed on one surface of a first insulation panel having an insulation portion inside a casing; and a protrusion formed to be inserted into the recess, on one surface of a second insulation panel having an insulation portion inside a casing, wherein the insulation portions are exposed to a bottom of the recess and a front end of the protrusion.

The related art insulation panels surrounded by a metal casing have a problem in that external heat is transferred to the inside of a cabinet of the refrigerator through a contact surface of the metal casing in a state that the insulation panels are connected with each other. Unlike the related art insulation panels, in the present invention, the insulation portion of nonmetal material is exposed to the bottom of the recess and the front end of the protrusion so as not to form a casing of high heat conductivity on a part of a contact surface between the insulation panels, whereby a heat transfer path along the contact surface of the casing is shielded to improve insulation efficiency.

Since the insulation panels fixed to each other are assembled as their sides are inserted to each other, the recess and the protrusion are longitudinally formed over the whole side length of the first insulation panel and the second insulation panel. Thus, a path of external heat into the cabinet through the contact surface of the casing of metal is completely shielded.

The casing having relatively high strength is extended to cover both surrounding surfaces of the recess and both surrounding surfaces of the protrusion, wherein the casing is designed to endure external impact well in a state that the protrusion of the second insulation panel is inserted into the recess of the first insulation panel.

At this time, insulation packing materials are additionally formed on any one of the bottom of the recess and the front end of the protrusion to ensure high insulation efficiency, so that the first insulation panel is fixed to the second insulation panel in a state that the front end of the protrusion is inserted into the bottom of the recess, whereby the heat transfer path through the contact surface of the casing can be shielded and airtightness can be maintained so as not to allow external air to be permeated into the casing.

Meanwhile, the insulation packing materials are more preferably formed on both the bottom of the recess and the front end of the protrusion, so that air or gas, which increases heat conductivity, can be prevented from being permeated into the insulation portion. At this time, the insulation packing materials formed on the front end of the protrusion and the bottom of the recess have thicknesses of which sum is 1/15 to 2/3 of a depth of the recess. If the sum of the thicknesses of the insulation packing materials is less than 1/15 of the depth of the recess, insulation characteristic improved by the insulation packing materials is low. If the sum of the thicknesses of the insulation packing materials is more than ⅔ of the depth of the recess, the insulation panels should be excessively pulled to fix them to each other, whereby assembly is deteriorated and the depth of the protrusion inserted into the recess becomes small to adversely affect fixing strength.

At this time, the insulation packing materials are formed of aerosol or hard urethane, and considering elastic factors of the insulation packing materials, a compression rate of the insulation packing materials is preferably less than 10% in case of aerosol and less than 20% in case of hard urethane in a state that the first insulation panel is fixed to the second insulation panel.

In order to endure load as the protrusion is fixed to the recess, the depth of the recess and the height of the protrusion are preferably more than 10 mm, and the width of the recess is 0.5 times more than the depth of the recess.

In order to enhance fixing strength between the first insulation panel and the second insulation panel, a fixing surface between the first insulation panel and the second insulation panel may be coated with an adhesive.

As described above, if the insulation packing materials are inserted, the insulation panels should be pulled to compress the insulation packing materials by a predetermined value. Accordingly, the fixing structure further includes a fixing nut fixed into the casing of any one of the first insulation panel and the second insulation panel, and a fixing bolt disposed in the casing of another one of the fixing insulation panel and the second insulation panel, wherein the fixing bolt is screwed onto the fixing nut to fix the first insulation panel to the second insulation panel. Thus, the fixing strength between the insulation panels can be enhanced, and a compression rate can conveniently be applied to the insulation packing materials.

The casing is formed of iron material in a portion where the casing is exposed to the outside in a state that the cabinet of the refrigerator is assembled, and is formed of plastic resin material in a portion where the casing is exposed to a cooling space in a state that the cabinet of the refrigerator is assembled. Although the casing may wholly be formed of iron material, it is difficult to assemble and handle the iron casing due to heavy weight. Accordingly, the inner side of the casing is preferably formed of plastic resin material to allow a user to feel good aesthetic sense.

The contact surface between the first insulation panel and the second insulation panel is sealed around its periphery to prevent external air from being permeated into the contact surface.

Meanwhile, a prefabricated refrigerator includes a cabinet fixed by the aforementioned insulation structure, and a cooling module cooling the inside of the cabinet.

The insulation portion of the insulation panels includes a core member formed in a vacuum state, a vacuum insulation panel having a sealing cover surrounding the core member and attached into the casing, and polyurethane foam foamed in a space inside the casing, which is not occupied by the vacuum insulation panel. Thus, it is possible to obtain insulation characteristics that are 30% better than the related art insulation characteristics.

In this case, the core member is formed of an inorganic material at a vacuum range below 0.1 torr. The sealing cover includes an outmost layer formed of any one of linear low density polyethylene (LLDPE) and high density polyethylene (HDPE), a protective layer formed of any one of PET and nylon, a gas permeation preventing layer formed of any one of an aluminum thin plate, EVOH, PVDC, and aluminum deposition film, and a heating-fusion bonding layer.

The vacuum insulation panel further includes a getter absorbing gas externally flowed or generated from the core member, so that insulation efficiency can be maintained for a long time.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 4 and 5 illustrate a fixing structure of insulation panels for a prefabricated refrigerator according to one embodiment of the present invention, in which FIG. 4 is a sectional view taken along line III-III of FIG. 1 and FIG. 5 is an enlarged view of a fixing portion of FIG. 3;

DETAILED DESCRIPTION OF THE INVENTION

Reference will now be made in detail to the preferred embodiments of the present invention, examples of which are illustrated in the accompanying drawings.

While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit of the invention as defined by the appended claims.

Figure 1:
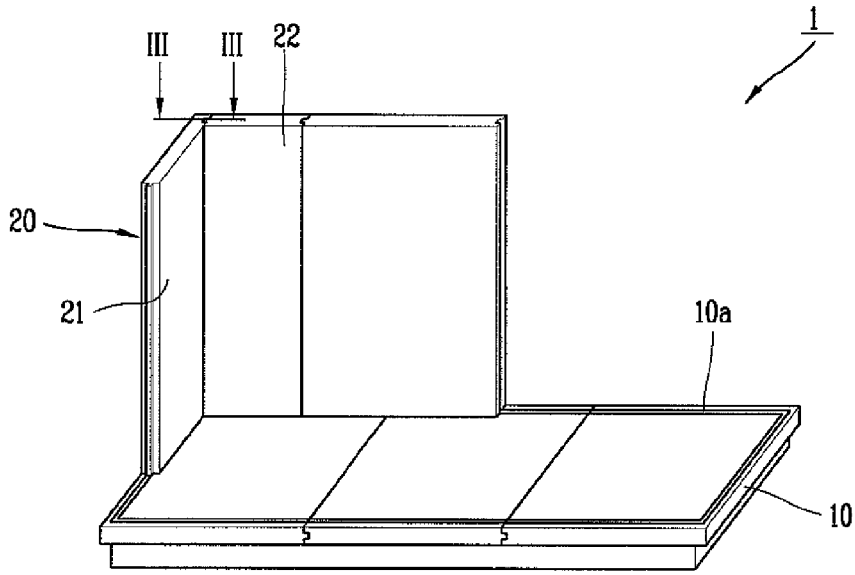
FIG. 1 CONVENTIONAL ART
FIG. 1 is a perspective view illustrating a related art prefabricated refrigerator and a fixing structure of insulation panels thereof.
Figure 2:
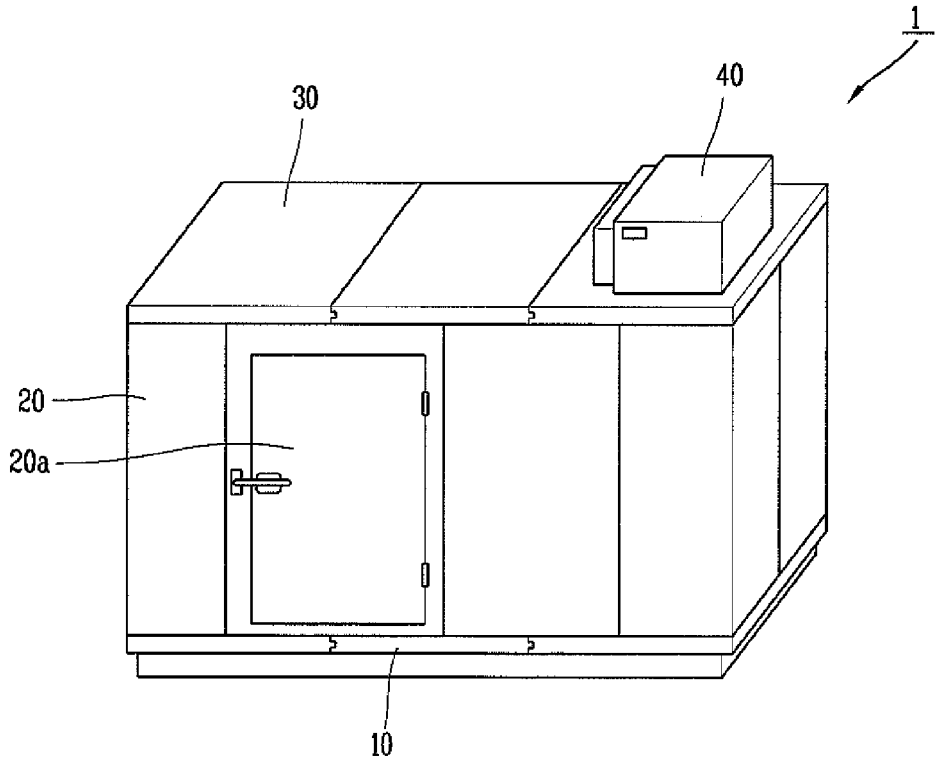
FIG. 2 CONVENTIONAL ART
FIG. 2 is a perspective view illustrating the state that assembly of the prefabricated refrigerator of FIG. 1 is completed.
Figure 3:
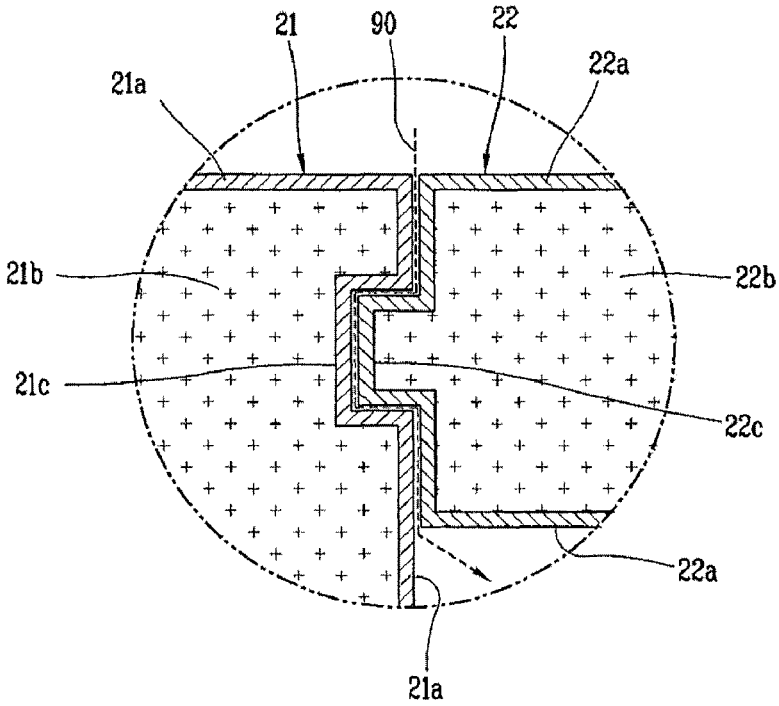
FIG. 3 CONVENTIONAL ART
FIG. 3 is a sectional view taken along line III-III of FIG. 1.
Figure 4:
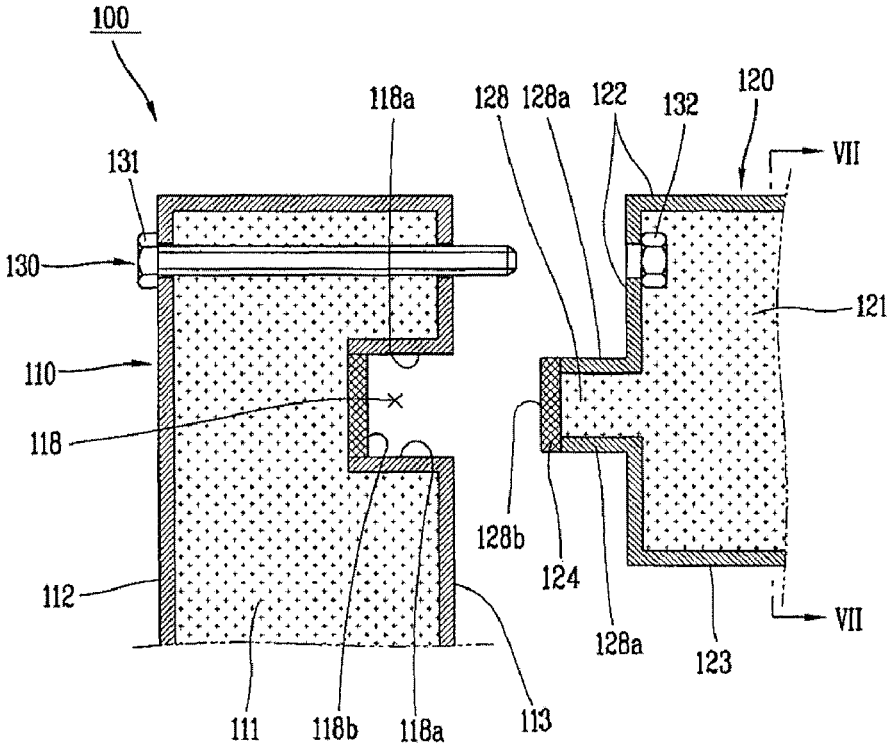
Figure 5:
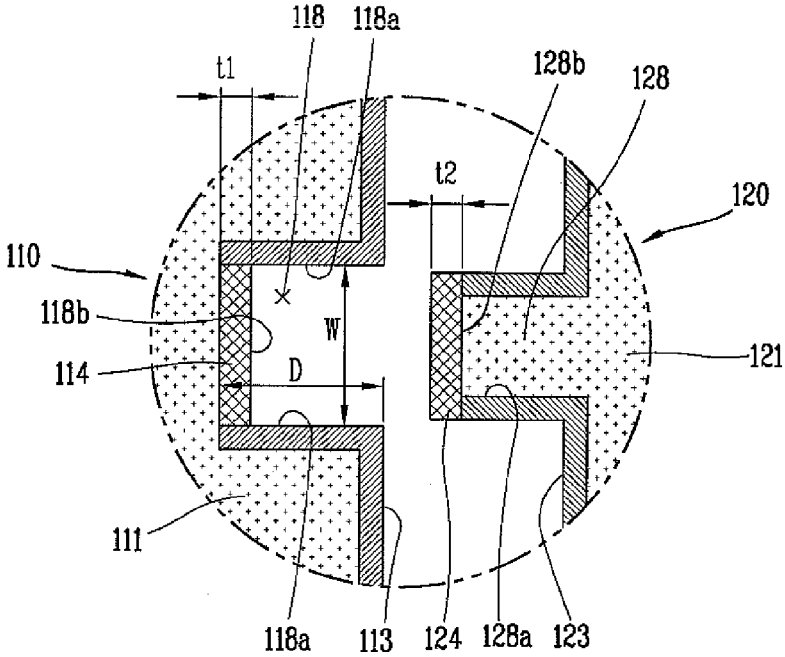

FIGS. 4 and 5 illustrate a fixing structure of insulation panels for a prefabricated refrigerator according to one embodiment of the present invention, in which FIG. 4 is a sectional view taken along line III-III of FIG. 1 and FIG. 5 is an enlarged view of a fixing portion of FIG. 3.

As shown, insulation panels 110 and 120 of a prefabricated refrigerator 100 according to one embodiment of the present invention include outer plates 112 and 122 of iron formed in a casing portion exposed to the outside in a state that they are assembled in a cabinet of the refrigerator, inner plates 113 and 123 of plastic formed in a casing portion exposed to a cooling space in a state that they are assembled in the cabinet of the refrigerator, a vacuum insulation panel 140 attached to the outer plates 112 and 122 between the outer plates 112 and 122 and the inner plates 113 and 123, and insulation portions 111 and 121 filled in another portion between the outer plates 112 and 122 and the inner plates 113 and 123 and formed of polyurethane foam.

The first insulation panel 110 is provided with a recess 118, and the second insulation panel 120 is provided with a protrusion 128 convexly protruded. In this case, the outer plate 112 and the inner plate 113 are extended to cover both surrounding surfaces 118*a* of the recess 118. Likewise, the outer plate 122 and the inner plate 123 are extended to cover both surrounding surfaces 128*a* of the protrusion 128. Thus, the first and second insulation panels 110 and 120 are engaged with each other by the extended outer and inner plates 112, 122, 113, and 123, so that a fixing portion of the insulation panels 110 and 120 can endure high load.

Insulation packing materials 114 and 124 of aerosol are respectively formed on both the bottom of the recess 118 and a front end 128*b* of the protrusion 128. In this case, the insulation packing materials 114 and 124 are compressed at a compression rate of about 70% in a state that the first insulation panel 110 is fixed to the second insulation panel 120, whereby airtightness is maintained so as not to flow external air into the cabinet of the refrigerator.

Referring to FIG. 5, the recess 118 is formed at a depth D of about 25 mm and a width W of 20 mm, and the insulation packing materials 114 and 124 are formed at thicknesses t1 and t2 of about 8 mm.

In order to compress the insulation packing materials 113 and 124 at a predetermined value, a fixing mechanism 130 for fixing the first insulation panel 110 to the second insulation panel 120 is additionally provided. In other words, a fixing bolt 131 is rotatably disposed movably in an axial direction in the first insulation panel 110, and a fixing nut 122 is fixed to an inner side of the outer plate 122 of the second insulation panel 120 by blazing. Accordingly, in a state that the protrusion 128 of the second insulation panel 120 is inserted into the recess 118 of the first insulation panel 110, the fixing bolt 131 is aligned with the fixing nut 132 so that the fixing bolt 131 is screwed onto the fixing nut 132, whereby the first insulation panel 110 is fixed to the second insulation panel 120.

As described above, since the outer plates 112 and 122 having high heat conductivity are not formed on the front end 128*b* of the protrusion 128 and the bottom 118*a* of the recess 118, heat conductivity from the outside of the cabinet to the cabinet through the outer plates 112 and 122 can be minimized. Also, since the insulation packing materials 114 and 124 of aerosol are formed on the front end 128*b* of the protrusion 128 and the bottom 118*a* of the recess 118, airtightness can be improved, whereby external gas or air can be prevented from flowing into the cabinet.

Figure 6:
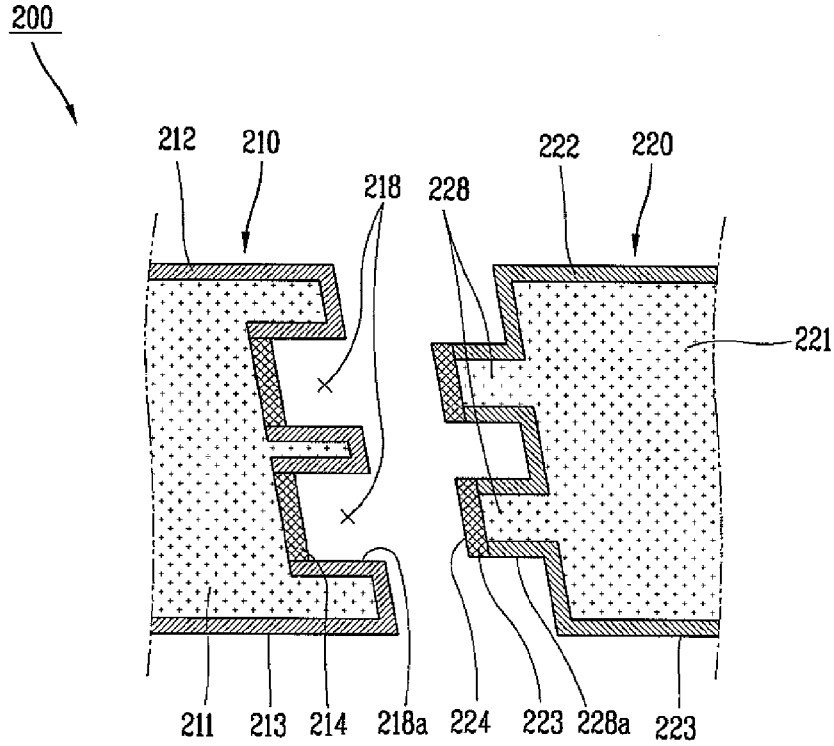
FIG. 6 is a sectional view taken along line III-III of FIG. 1, illustrating a fixing structure of insulation panels for a prefabricated refrigerator according to another embodiment of the present invention.

Meanwhile, as shown in FIG. 6, although insulation panels 210' and 220' are similar to those of the aforementioned refrigerator 100, they are different from those of the aforementioned refrigerator 100 in that sides of the first and second insulation panels 210' and 220' are fixed to each other.

In this case, the second insulation panel 220' is provided with two protrusions 228', and the first insulation panel 210' is provided with two recesses 218' into which the protrusions 228' are inserted. Joints 218' and 228' of the insulation panels 210' and 220' are formed in protrusion and recess shapes. A fixing portion of the insulation panels 210' and 220' is inclined with respect to outer plates so that a heat transfer path becomes longer within the limits of the possible, whereby cooling air can effectively be prevented from being leaked out.

Furthermore, the fixing portion of the insulation panels 210' and 220' is filled with a gasket or a sealant so as not to leak the cooling air out.

At this time, the bottom of the two recesses 218' and the front end of the protrusion 228' are provided with insulation packing materials 214 and 224 of hard urethane.

Since the two protrusions 228' and the two recesses 218' are provided to fix the insulation panels 210' and 220' to each other, higher airtightness than that of the aforementioned embodiment can be obtained, and heat conductivity from the outside of the cabinet to the inside of the cabinet through the outer plates 212 and 222 or the inner plates 213 and 223 can be minimized.

Figure 7:
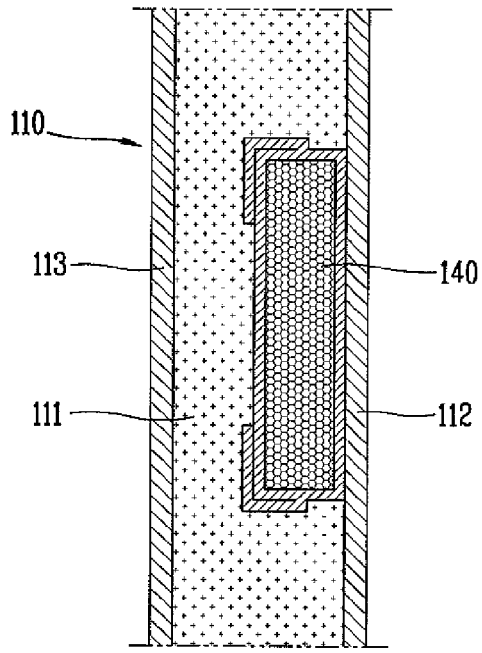
FIG. 7 is a sectional view taken along line VII-VII of FIG. 4.
Figure 8:
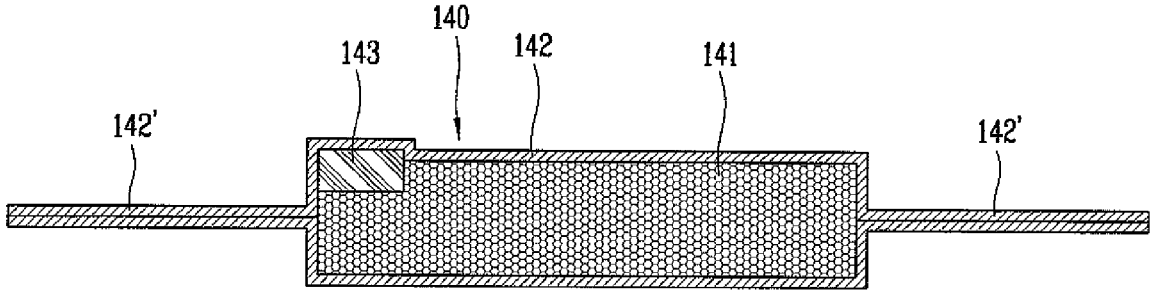
FIG. 8 is a sectional view illustrating a vacuum insulation panel of FIG. 7.
Figure 9:
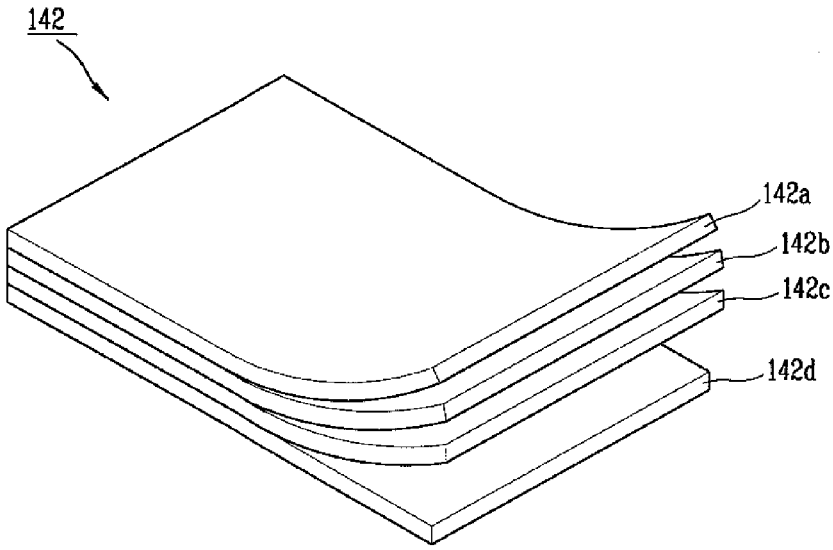
FIG. 9 is a perspective view illustrating a cover film of a vacuum insulation panel of FIG. 7.

FIG. 7 is a sectional view taken along line VII-VII of FIG. 4, FIG. 8 is a sectional view illustrating the vacuum insulation panel of FIG. 7, and FIG. 9 is a perspective view illustrating a cover film of the vacuum insulation panel of FIG. 7. In addition to the polyurethane foam 111, the vacuum insulation panel 140 is fixed to the inner sides of the outer plates 112 and 122 inside the insulation panels 110 and 120, so that insulation efficiency in a thickness direction of the insulation panels 110 and 120 can be improved by about 20%.

The vacuum insulation panel 140 includes a core member 141 formed of panels woven from inorganic glass fiber and deposited, having a vacuum state between the panels, a sealing cover 142 formed to surround the core member 141 to maintain the vacuum state of the core member 141, and a layer-shaped getter 143 inserted into the core member 141 to maintain insulation efficiency for a sufficient time period by removing gas component flowed through the sealing cover envelope 142.

The core member 141 is formed of the inorganic glass fiber known for its excellent insulation characteristics, and also is formed by depositing panels woven from thin glass fiber, whereby a high insulation effect can be obtained. A vacuum range in the vacuum insulation panel 140 is maintained below 0.1 torr.

The sealing cover 142 includes an outmost layer 142*a* formed of a nylon material to be exposed to the outer surface of the vacuum insulation panel 140, a protective layer 142*b* deposited on the bottom of the outmost layer 142*a*, a gas permeation preventing layer 142*c* deposited with an aluminum thin plate on the bottom of the protective layer 142*b*, and a heating-fusion bonding layer 142*d* deposited on the bottom of the gas permeation preventing layer 142*c* in contact with the core member 141.

The outmost layer 142*a* is formed of a nylon material having excellent elasticity at a thickness of about 25 μm. The protective layer 142*b* is also formed of a nylon material having excellent elasticity at a thickness of about 15 μm. Thus, the vacuum insulation panel 140 can be prevented from being damaged by external impact during its assembly or installation. In particular, considering that the vacuum insulation panel 140 is manufactured at a large size to improve its efficiency and thus its probability of defect increases, the vacuum insulation panel 140 of the nylon material can be prevented from being damaged by external impact or scratch, whereby the probability of defect can be avoided in advance.

The gas permeation preventing layer 142*c* is deposited to prevent external gas or moisture from being permeated into the core member 141, and is preferably formed of A8000 based material containing Fe of 7 wt % to 1.3 wt %, more preferably A8079 based material. As shown in FIG. 9, since the A8079 material has crystal grains finer than that of the related art A1235 material, slips between the crystal grains decrease, so that allowable stress increases to endure a process step such as rolling, thereby increasing ductility.

Unlike the related art butene based linear low density polyethylene (LLDPE) having four carbons, since the heating-fusion bonding layer 142*d* is formed of octane based LLDPE having eight carbons at a thickness of about 50 μm, it has improved heat-resistant performance and sealing strength. Also, the heating-fusion bonding layers 142*d* of protrusions 142' protruded in contact with upper and lower surfaces of the core member 141 are bonded to each other, so that vacuum of the core member 141 can be maintained more effectively.

As described above, the sealing cover 142 according to one embodiment of the present invention, which is formed in such a manner that the outmost layer 142*a*, the protective layer 142*b*, the gas permeation preventing layer 142*c* and the heating-fusion bonding layer 142*d* are deposited, has oxygen permeability of 0.005 cc/m$^2$ for 48 hours under the condition of relative humidity of 0% and 23° C. and water vapor transmission rate of 0.005 g/m$^2$ for 48 hours under the condition of relative humidity of 100% and 38° C. Therefore, it is noted that the sealing cover 142 has excellent performance in preventing external air or moisture from being permeated thereinto.

Also, the getter 130 is formed of an alloy of CaO or Ba—Li.

The aforementioned vacuum insulation panel 140 is formed at a thickness of 10 cm if the insulation panels 110 and 120 have a thickness of 30 cm, and is attached to the outer plates 112 and 122 to occupy 70% or greater of the whole area of the insulation panels 110 and 120 except the fixing portion of the insulation panels 110 and 120.

As the aforementioned vacuum insulation panel 140 is applied to the insulation panels 110 and 120 for the prefabricated refrigerator, the heat conductivity coefficient in a thickness direction of the insulation panels is in the range of 0.0030 W/m·K to 0.0035 W/m·K, whereby insulation efficiency more excellent five times than that of the related art polyurethane foam can be obtained. Also, it is noted that the prefabricated refrigerator having the polyurethane foam and the vacuum insulation panel 140 as shown in FIG. 7 has insulation efficiency 30% better than that of the related art prefabricated refrigerator.

Furthermore, it is noted that insulation efficiency and durability can be improved as the inclined structure having a large leakage path is formed in the joint portion of the insulation panels 110 and 210 to prevent the cooling air from being leaked out and the gasket is inserted in the joint portion of the insulation panels 110 and 210.

The prefabricated refrigerator and the fixing structure of the insulation panels of the prefabricated refrigerator according to the present invention have the following advantages.

According to the present invention, the recess is recessed on one surface of the first insulation panel having the insulation portion inside the casing, and the protrusion is formed to be inserted into the recess, on one surface of the second insulation panel having the insulation portion inside the casing, so that the recess and the protrusion constitute a contact area of the insulation panels, and the insulation portion of nonmetal material is exposed to the bottom of the recess and the front end of the protrusion, whereby the heat transfer path along the contact area of the insulation panels is shielded to improve insulation efficiency.

Also, since the contact area between the first insulation panel and the second insulation panel is inclined with respect to the outer plates of the insulation panels, the path from the outside of the cabinet to the inside of the cabinet is maximized.

Moreover, since both the vacuum insulation panel and the polyurethane foam are provided inside the insulation panels of the prefabricated refrigerator, improved insulation characteristics in a thickness direction can be obtained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A fixing structure of insulation panels of a prefabricated refrigerator, the insulation panels constituting a cabinet of the prefabricated refrigerator, comprising:

a recess defined at one surface of a first insulation panel, the first insulation panel having a first insulation portion inside a first casing; and a protrusion disposed on one surface of a second insulation panel, the second insulation panel having a second insulation portion inside a second casing, the second casing extending to cover side surfaces of the protrusion, the protrusion being configured to be inserted into the recess, wherein, on the protrusion, the second casing extends only along the side surfaces of the protrusion, wherein the first insulation portion is exposed to insulation packing materials at a bottom of the recess and the second insulation portion is exposed to the insulation packing materials at a front end of the protrusion, and wherein the insulation packing materials are disposed between the bottom of the recess and the front end of the protrusion and the first insulation panel is fixed to the second insulation panel in an air-tight manner.

2. The fixing structure of insulation panels of a prefabricated refrigerator as claimed in claim 1, wherein the recess and the protrusion are formed over the entire length of a contact surface between the first insulation panel and the second insulation panel.

3. The fixing structure of insulation panels of a prefabricated refrigerator as claimed in claim 2, wherein the first casing extends to cover side surfaces of the recess, and wherein the insulation packing materials are arranged in one or more layers such that the front end of the protrusion does not contact the bottom of the recess when the first insulation panel is fixed to the second insulation panel.

4. The fixing structure of insulation panels of a prefabricated refrigerator as claimed in claim 1, wherein the insulation packing materials are formed of hard urethane and have a compression rate less than 20% in a state that the first insulation panel is fixed to the second insulation panel.

5. The fixing structure of insulation panels of a prefabricated refrigerator as claimed in claim 1, wherein the insulation packing materials are formed of aerosol and have a compression rate less than 10% in a state that the first insulation panel is fixed to the second insulation panel.

6. The fixing structure of insulation panels of a prefabricated refrigerator as claimed in claim 3, wherein the recess has a depth D more than 10 mm, the protrusion has a height more than 10 mm, and recess has a width W 0.5 times more than the depth D of the recess.

7. The fixing structure of insulation panels of a prefabricated refrigerator as claimed in claim 2, further comprising:

a fixing nut fixed into the casing of any one of the first insulation panel and the second insulation panel; and a fixing bolt disposed in the casing of another one of the first insulation panel and the second insulation panel, wherein the fixing bolt is screwed onto the fixing nut to fix the first insulation panel to the second insulation panel.

8. The fixing structure of insulation panels of a prefabricated refrigerator as claimed in claim 7, wherein the fixing nut is fixed into the casing by welding.

9. The fixing structure of insulation panels of a prefabricated refrigerator as claimed in claim 2, wherein the casings are formed of iron material in a portion where the casings are exposed to the outside in a state that the cabinet of the refrigerator is assembled, and the casings are formed of plastic resin material in a portion where the casings are exposed to a cooling space in a state that the cabinet of the refrigerator is assembled.

10. The fixing structure of insulation panels of a prefabricated refrigerator as claimed in claim 2, wherein the bottom of the recess and the front end of the protrusion are formed in an inclined direction with respect to sections of the insulation panels.

11. The fixing structure of insulation panels of a prefabricated refrigerator as claimed in claim 2, wherein the contact surface between the first insulation panel and the second insulation panel is sealed around its periphery.

12. A fixing structure of insulation panels of a prefabricated refrigerator, comprising:

a recess defined on one surface of a first insulation panel having a first insulation portion between a first outer plate exposed to an exterior space and a first inner plate exposed to a cooling space; and a protrusion disposed to be engaged with the recess, on one surface of a second insulation panel having a second insulation portion between a second outer plate exposed to an exterior space and a second inner plate exposed to a cooling space, the second outer plate extending to cover a side surface of the protrusion and the second inner plate extending to cover an opposite side surface of the protrusion, wherein, on the protrusion, the second inner plate and the second outer plate extend only along the side surfaces of the protrusion, wherein the first outer plate and the first inner plate of the first insulation panel are spaced apart from each other on a bottom of the recess, and the second outer plate and the second inner plate of the second insulation panel are spaced apart from each other on a front end of the protrusion, the first insulation portion is exposed to insulation packing materials at a bottom of the recess and the second insulation portion is exposed to the insulation packing materials at a front end of the protrusion, and the insulation packing materials are disposed between the bottom of the recess and the front end of the protrusion so that the first insulation panel is fixed to the second insulation panel in an air-tight manner.

13. The fixing structure of insulation panels of a prefabricated refrigerator as claimed in claim 12, wherein the bottom of the recess and the front end of the protrusion are inclined.

14. The fixing structure of insulation panels of a prefabricated refrigerator as claimed in claim 12, wherein the insulation packing materials have thicknesses of which sum is $1/15$ to $2/3$ of a depth D of the recess.

15. The fixing structure of insulation panels of a prefabricated refrigerator as claimed in claim 12, wherein a contact surface between the first insulation panel and the second insulation panel is coated with an adhesive.

16. The fixing structure of insulation panels of a prefabricated refrigerator as claimed in claim 12, wherein the first inner plate extends to cover a side surface of the recess and the first outer plate extends to cover an opposite side surface of the recess, and wherein, on the protrusion, the insulation packing materials extend only along the front end of the protrusion, wherein the insulation packing materials comprise a material different from a material of the second outer plate and different from a material of the second inner plate.

17. The fixing structure of insulation panels of a prefabricated refrigerator as claimed in claim 12, further comprising:

a fixing bolt disposed in the casing of one of the first insulation panel and the second insulation panel; and a fixing nut configured to receive the fixing bolt, the fixing nut being disposed in the casing of the other of the first insulation panel and the second insulation panel, wherein the fixing bolt is configured to extend through the first outer plate and the second outer plate when the first insulation panel is fixed to the second insulation panel, without extending through the first inner plate or the second inner plate.

18. The fixing structure of insulation panels of a prefabricated refrigerator as claimed in claim 12, wherein the second outer plate comprises a material different from materials of the second inner plate.

19. The fixing structure of insulation panels of a prefabricated refrigerator as claimed in claim 1, wherein the front end of the protrusion engages materials other than materials of the casing.

20. The fixing structure of insulation panels of a prefabricated refrigerator as claimed in claim 19, wherein the front end of the protrusion is exposed to the insulation packing materials without engaging the materials of the casing.

* * * * *